US009504875B2

(12) United States Patent
Han et al.

(10) Patent No.: US 9,504,875 B2
(45) Date of Patent: Nov. 29, 2016

(54) PORTABLE REHABILITATION EXERCISE DEVICE FOR KNEE JOINT

(71) Applicant: HEXAR SYSTEMS CO., LTD., Ansan-si, Gyeonggi-do (KR)

(72) Inventors: Jung-Soo Han, Seoul (KR); Chang-Soo Han, Seoul (KR)

(73) Assignee: HEXAR SYSTEMS CO., LTD., Ansan-Si (KR)

( * ) Notice: Subject to any disclaimer, the term of this patent is extended or adjusted under 35 U.S.C. 154(b) by 0 days.

(21) Appl. No.: 14/438,202

(22) PCT Filed: Oct. 24, 2013

(86) PCT No.: PCT/KR2013/009528

§ 371 (c)(1),
(2) Date: Apr. 23, 2015

(87) PCT Pub. No.: WO2014/065609

PCT Pub. Date: May 1, 2014

(65) Prior Publication Data

US 2015/0273273 A1 Oct. 1, 2015

(30) Foreign Application Priority Data

Oct. 24, 2012 (KR) ..... 10-2012-0118632
Oct. 24, 2013 (KR) ..... 10-2013-0126858

(51) Int. Cl.

| | |
|---|---|
| ***A63B 24/00*** | (2006.01) |
| ***A63B 21/002*** | (2006.01) |
| ***A63B 21/00*** | (2006.01) |
| ***A63B 69/00*** | (2006.01) |
| ***A63B 21/005*** | (2006.01) |
| ***A63B 23/035*** | (2006.01) |
| ***A63B 23/04*** | (2006.01) |
| *A63B 71/00* | (2006.01) |

(52) U.S. Cl.

CPC ..... *A63B 24/0087* (2013.01); *A63B 21/002* (2013.01); *A63B 21/0058* (2013.01); *A63B 21/00181* (2013.01); *A63B 21/4011* (2015.10); *A63B 21/4025* (2015.10); *A63B 21/4047* (2015.10); *A63B 23/03508* (2013.01); *A63B 23/0494* (2013.01); *A63B 69/0059* (2013.01); *A63B 2024/0093* (2013.01); *A63B 2071/0072* (2013.01); *A63B 2210/50* (2013.01); *A63B 2220/51* (2013.01); *A63B 2225/50* (2013.01)

(58) Field of Classification Search

CPC ..... A63B 24/00; A63B 24/0062; A63B 24/0087; A63B 21/002; A63B 21/00181; A63B 21/4011; A63B 21/4047; A63B 21/0058; A63B 21/4025; A63B 2024/0093; A63B 69/0059; A63B 23/03508; A63B 23/0494; A63B 2071/0072

See application file for complete search history.

(56) References Cited

U.S. PATENT DOCUMENTS

2005/0101887 A1 5/2005 Stark et al.

FOREIGN PATENT DOCUMENTS

| | | | |
|---|---|---|---|
| JP | 2010-063581 | A | 3/2010 |
| KR | 10-2010-0018599 | A | 2/2010 |
| KR | 10-2010-0115287 | A | 10/2010 |
| KR | 10-2012-0103951 | A | 9/2012 |

*Primary Examiner* — Glenn Richman
(74) *Attorney, Agent, or Firm* — Maschoff Brennan

(57) ABSTRACT

Provided is a portable rehabilitation exercise device for a knee joint, the portable rehabilitation exercise device being configured such that a lower leg-worn part is rotatably connected to a thigh-worn part and a driving device for rotating the lower leg-worn part is provided in connection portions, the driving device being controlled by a control device for an isokinetic exercise so that a rehabilitation effect can be improved and the portable rehabilitation exercise device can be conveniently used without a space restriction.

16 Claims, 6 Drawing Sheets

PORTABLE REHABILITATION EXERCISE DEVICE FOR KNEE JOINT

TECHNICAL FIELD

The present invention relates generally to a portable rehabilitation exercise device for a knee joint and, more particularly, to a portable rehabilitation exercise device for a knee joint that can be used without a space restriction and can improve a user's convenience and rehabilitation effects upon a remedial exercise.

The present application claims the benefit of Korean Patent Application Nos. 10-2012-0118632, filed on Oct. 24, 2012, and 10-2013-0126858, filed on Oct. 24, 2013, the contents of which are entirely incorporated herein by reference.

BACKGROUND ART

In general, in the case of a person who does not move his or her joint for a long time due to fracturing his or her joint region or a joint surgery, the person's joint region becomes weak or stiff.

Since many elderly people having weakened muscular strength and weakened joint regions due to aging have difficulty walking, their walking decreases gradually, and accordingly, their joint regions become further weakened or stiffened.

As such, patients who have weakened muscular strength due to a fracture accident or aging need to continuously perform exercise capable of increasing unit muscle strength. Furthermore, as described above, patients having a joint stiffened due to a fracture accident and aging need to exercise in such a manner as to gradually extend the scope of the exercise, so that they can smoothly move their joints.

In particular, since the knee joint is the most important joint for walking, when unit muscular strength becomes weak and the joint becomes stiff, the unit muscular strength and joint should be recovered through rehabilitation exercise so that the patients can avoid difficulty in walking.

A general device for rehabilitating a knee is configured such that a joint exercise tool intended for enabling a user to move his or her knee joints is provided in a bed in which the user can lay so that the user can repeat motions of bending and straightening his or her knee joints in a state of lying in bed.

It is problematic in that such a knee rehabilitation device has a small size and is not portable because it is installed at the bed in which the user can lay.

Also, it is problematic in that the knee rehabilitation device needs a large space upon use and it is costly to manufacture.

Also, it is problematic in that the knee rehabilitation device is inconvenient to wear upon use and is difficult to provide a suitable amount of rehabilitation exercise because it is impossible to change its mounting position according to each user's height.

Also, it is problematic in that the knee rehabilitation device is not able to select suitable rehabilitation exercises for the user and has a low rehabilitation effect because a controlling method of the joint exercise tool of the knee rehabilitation device allows the user to simply perform a reciprocally uniform motion by only regularly adjusting a predetermined angle and speed regardless of the user's needs.

An Example of a conventional patent related with the present application includes Korean Patent Laid-Open Publication No. 10-2010-0115287 entitled 'Rehabilitation Exercise Device for a Knee Joint' (Oct. 27, 2010).

DISCLOSURE

Technical Problem

An object of the present invention is to provide a portable rehabilitation exercise device for a knee joint that can improve a rehabilitation effect by selectively using a general rehabilitation exercise mode and an isokinetic exercise mode for rehabilitation and can be conveniently used without a space restriction.

Technical Solution

In order to accomplish the above object, the present invention provides a portable rehabilitation exercise device for a knee joint, including: a thigh-worn part worn on a user's thigh; a lower leg-worn part rotatably connected to the thigh-worn part and worn on a user's lower leg; a driving device mounted to connection portions between the thigh-worn part and the lower leg-worn part and intended for rotatably operating the lower leg-worn part; and a control device controlling an operation of the driving device.

Advantageous Effects

As described above, a portable rehabilitation exercise device for a knee joint according to the present invention is configured such that a general rehabilitation exercise mode capable of exercising a user's knee joint by only an operation of the driving device 50 and an isokinetic exercise mode capable of exercising the user's knee joint at a constant velocity by an operation resulting from the user's movement may be selectively used so that a rehabilitation effect of the knee joint can be largely improved.

The portable rehabilitation exercise device for the knee joint according to the present invention is portable and easy to use even in a small space. Furthermore, the portable rehabilitation exercise device for the knee joint can be operated only when the user's motion is detected, and can store the user's rehabilitation exercise information and can update the information by giving feedback, thereby improving a knee joint rehabilitation effect.

The portable rehabilitation exercise device for the knee joint according to the present invention may be appropriately worn according to the user's body type and the user's selection between his or her left and right knees so that convenience can be largely improved and a rehabilitation effect can be also improved.

Figure 1:
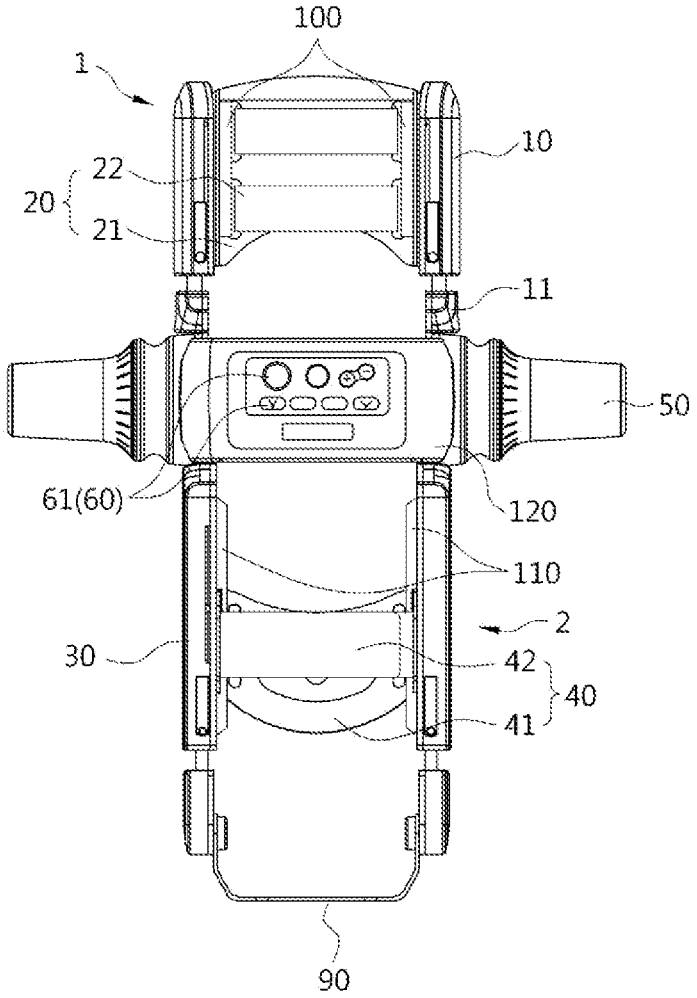
FIG. 1 is a plan view illustrating a portable rehabilitation exercise device for a knee joint according to the present invention.

<Description of Main Reference Numerals in the Drawings>

| | |
|---|---|
| 1: Thigh-worn part | 2: Lower leg-worn part |
| 10: First mounting frame member | 20: First band member |
| 30: Second mounting frame member | 40: Second band member |
| 50: Driving device | 60: Control device |
| 65: Sensor member | 70: Supporter member |
| 90: Foot supporting member | 100: Thigh supporting pad member |
| 110: Lower leg supporting pad member | 120: Knee covering member |

BEST MODE

Preferred embodiments of the present invention will be described in detail below with reference to the accompanying drawings.

FIG. 1 is a plan view illustrating a portable rehabilitation exercise device for a knee joint according to the present invention. Referring to FIG. 1, the portable rehabilitation exercise device for the knee joint according to the present invention includes: a thigh-worn part 1 worn on a user's thigh; and a lower leg-worn part 2 rotatably connected to the thigh-worn part 1 and worn on a user's lower leg;

The thigh-worn part 1 includes: first mounting frame members 10 each disposed on both sides of the user's thigh; and a first wearing member 20 provided in the first mounting frame members 10 and worn to wrap the user's thigh.

The first wearing member 20 includes a first belt 22 worn to wrap the user's thigh.

The lower leg-worn part 2 includes: second mounting frame members 30 rotatably connected to each one end of the first mounting frame members 10 and each disposed on both sides of the user's lower leg; and a second wearing member 40 provided in the second mounting frame members 30 and worn to wrap the user's low leg.

The second wearing member 40 includes a second belt 42 worn to wrap the user's lower leg.

Since each length of the first belt 22 and the second belt 42 in a Velcro band style, a belt buckle style, and the like can be adjusted, the first belt and the second belt can be worn to suit each user's body type.

A driving device 50 is mounted to connection portions between the thigh-worn part 1 and the lower leg-worn part 2. That is, the driving device 50 is mounted to the connection portions between the first mounting frame members 10 and the second mounting frame members 30. The driving device 50 rotatably operates the second mounting frame members 30. The driving device 50 includes: a motor (not drawn) rotated by an electric power source; and a reducer (not drawn) intended for reducing and transmitting a turning force of the motor. The driving device 50 is connected to a control device 60, wherein the control device 60 controls an operation of the driving device 50.

The driving device 50 enables the lower leg-worn part 2 to reciprocally and rotatably move within a predetermined scope. The driving device rotates the lower leg-worn part 2 in a direction in which the lower leg-worn part 2 ascends, namely, the user lifts his or her leg, and also rotates the lower leg-worn part 2 in a direction in which the lower leg-worn part 2 descends, namely, the user lowers his or her leg.

It is preferable to further include a knee covering member 120 mounted to the connection portions between the thigh-worn part 1 and the lower leg-worn part 2 and intended for covering a user's knee. The knee covering member 120 allows the user to perform a stable rehabilitation exercise by operating the driving device 50 and supporting the user's knee upon the rehabilitation exercise.

Also, the portable rehabilitation exercise device for the knee joint according to the present invention further includes a foot supporting member 90 connected to the lower leg-worn part 2 and worn on a user's foot. The foot supporting member 90 is detachably mounted to a lower end of the lower leg-worn part 2, so that it can be mounted to the lower end of the lower leg-worn part upon use, or can be separated from the lower end of the lower leg-worn part when not used.

The foot supporting member 90 is worn on the user's foot so that the user's lower leg can be more stably exercised upon operating of the second mounting frame members 30. In particular, when the user rotates the lower leg for himself or herself by applying a force intended for moving the lower leg to the lower leg, the foot supporting member helps the user with moving the lower leg so that a rehabilitation effect can be improved.

Also, the portable rehabilitation exercise device for the knee joint according to the present invention further includes: thigh supporting pad members 100 detachably mounted to each inner surface of the first mounting frame members 10; and lower leg supporting pad members 110 detachably mounted to each inner surface of the second mounting frame members 3.

The thigh supporting pad members 100 and the lower leg supporting pad members 110 are manufactured as replaceable parts for the user's left and right knees, and in various sizes and shapes so as to be separated and replaced.

When the user selects any one between his or her left and right knees, the thigh supporting pad members 100 and the lower leg supporting pad members 110, which are fit for a left or right direction according to the user's selection, are mounted to the first mounting frame members 10 and the second mounting frame members 30, respectively.

Also, the thigh supporting pad members 100 and the lower leg supporting pad members 110 having a suitable size and shape for the user's body type are mounted to the first mounting frame members 10 and the second mounting frame members 30, respectively.

Accordingly, the portable rehabilitation exercise device for the knee joint according to the present invention may be appropriately adjusted according to the user's body type and the user's selection between the left and right knees and may be stably worn and used.

Also, the control device 60 is mounted to the knee covering member 120 so that portability and usability can be improved. The control device 60 operates the driving device 50 using a plurality of operation modes and includes an input part 61 intended for selecting any one of the plurality of operation modes and inputting an operational condition according to the selected mode.

It is preferable that the input part 61 be provided on a surface of the knee covering member 120. The input part 61 is provided on the surface of the knee covering member 120, namely, on an upper surface of the knee covering member, so that the user can more conveniently input the operational condition and can operate the operation modes.

Also, the control device 60 includes at least one of a wireless controller and a wired controller capable of remotely controlling the plurality of operation modes so that usability can be further improved.

The driving device 50 is connected to the control device 60, and the control device 60 controls the operation of the driving device 50.

The control device 60 controls the driving device 50 so as to enable the lower leg-worn part 2 to be reciprocally rotated within a predetermined rotation scope.

Figure 2:
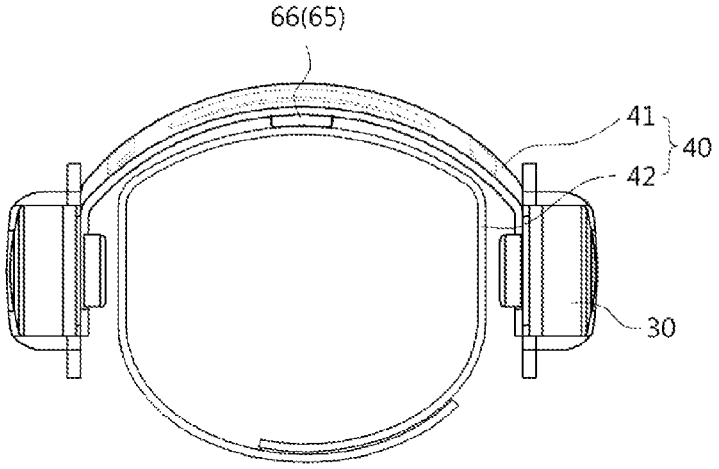
FIG. 2 is a view illustrating one embodiment of a lower leg-worn part of the portable rehabilitation exercise device for the knee joint according to the present invention.

Referring to FIG. 2, the portable rehabilitation exercise device for the knee joint according to the present invention includes a sensor member 66 mounted to the lower leg-worn part 2, connected the control device 60, and intended for detecting a moving direction of the user's lower leg moved by the user.

The control device 60 operates the driving device 50 when the moving direction of the user's lower leg is detected by the sensor member 66, thereby rotating the second mounting frame members 30 in the detected moving direction. That is, the sensor member 66 detects a direction and magnitude of force when the user applies a certain amount or more of force to the moving direction intended for rotating the lower leg using his or her knee and transmits detected information to the control device 60. Furthermore, the control device 60 rotates the second mounting frame members 30 in the direction of the force detected by the sensor member 66. In the present invention, as described above, when the user attempts to move his or her lower leg with a certain amount or more of force, the second mounting frame members 30 are rotated in a direction to which the force is applied so as to help with the user's rehabilitation exercise.

Also, the sensor member 66 detects a load by which the user's lower leg is moved namely, the magnitude of force, thereby transmitting the detected information to the control device 60. The control device 60 enables a rotational speed of the lower leg-worn part 2 to be maintained at a constant velocity by controlling the operation of the driving device 50 in the direction of the force detected by the sensor member 66. That is, the control device 60 enables the rotational speed of the lower leg-worn part 2 to be pre-determined according to the user's needs. The control device 60 receives information about the direction and magnitude of the force detected by the sensor member 66 and operates the driving device 50 so that the lower leg-worn part 2 can be rotated at a predetermined rotational speed according to the relevant user's needs.

While the sensor member 66 detects the load, the control device 60 operates the driving device 50, and when the sensor member 66 fails to detect the load, the control device stops the driving device 50.

The second wearing member 40 includes: a calf supporting bracket 41, both sides of which are each connected to the second mounting frame members, the calf supporting bracket being disposed on a user's calf; and a second belt 42 connected to the calf supporting bracket 41 and worn to wrap the user's thigh. The calf supporting bracket 41 has a curved shape so as to wrap the user's calf and supports the user's calf when the user performs a knee rehabilitation exercise, thereby allowing the user to smoothly perform the rehabilitation exercise.

As one example, the sensor member 66 is a tension-compression sensor **66*a*, both ends of which are mounted to the calf supporting bracket 41 and the second belt 42, respectively, thereby connecting the calf supporting bracket 41 and the second belt 42**.

The tension-compression sensor **66*a* mounted to the calf supporting bracket 41 and the second belt 42 detects a tensile force when the user applies a force for lifting his or her lower leg in a state of wearing the second belt 42 on the lower leg and also detects a compressive force when the user applies a force for lowering his or her lower leg, thereby transmitting detected information to the control device 60**.

The control device 60 controls the operation of the driving device 50 according to the direction and magnitude of the force detected by the tension-compression sensor **66*a***.

Also, the sensor member 66 may include a first compression sensor (not drawn) mounted in the center of the calf from an inner circumferential surface of the second belt 42 and a second compression sensor (not drawn) mounted to a side opposite to the first compression sensor.

The first compression sensor detects a compressive force when the user applies a force for lifting his or her lower leg, thereby transmitting detected information to the control device 60. Also, the second compression sensor detects a compressive force when the user applies a force for lowering his or her lower leg, thereby transmitting detected information to the control device 60.

The control device 60 controls the operation of the driving device 50 according to the magnitude of the force detected by any one of the first compression sensor and the second compression sensor.

That is, the portable rehabilitation exercise device for the knee joint according to the present invention is configured such that the sensor member 66 detects the force intended by the user for moving the user's lower leg, namely, a force intended for exercising a user's joint by rotating his or her lower leg, and the control device 60 controls the operation of the driving device 50 at a constant velocity according to the direction of the force detected by the sensor member 66 so that an isokinetic exercise for the knee joint can be performed.

The control device 60 rotates the lower leg-worn part 2 uniformly at a predetermined rotational speed according to the user's needs only when the force applied by the user is detected by the sensor member 66 so that an effect of the isokinetic exercise can be maximized.

Figure 3:
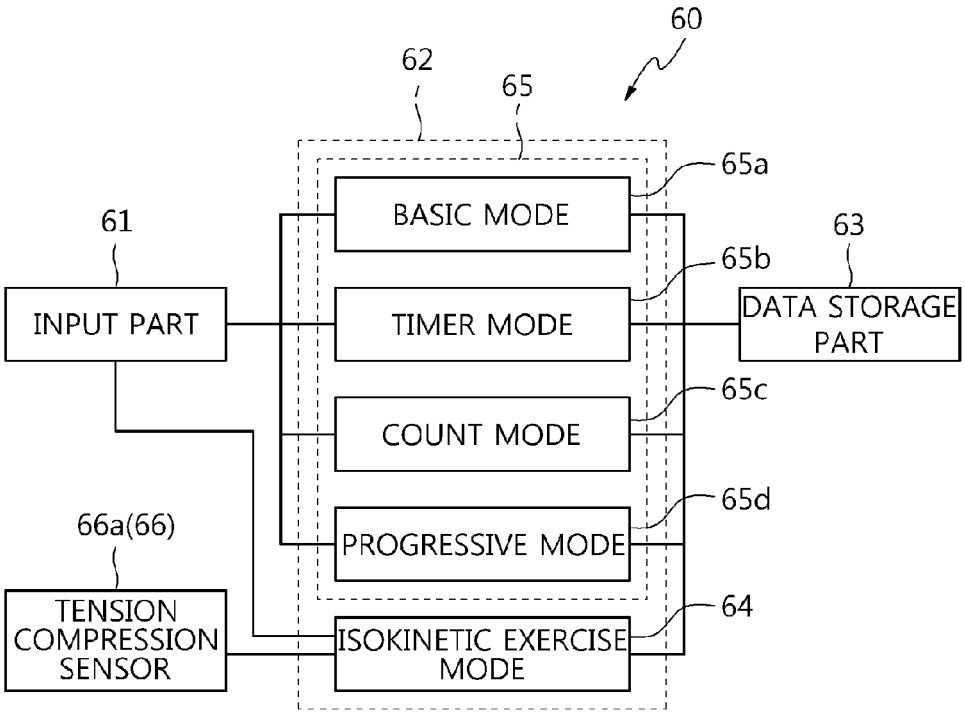
FIG. 3 is a block diagram illustrating one example of a control device of the portable rehabilitation exercise device for the knee joint according to the present invention.

FIG. 3 is a block diagram illustrating one example of the control device 60 of the portable rehabilitation exercise device for the knee joint according to the present invention. Referring to FIG. 3, the control device 60 includes an isokinetic exercise mode 64 capable of controlling the driving device 50 using an isokinetic exercise so that the user's knee joint can be rehabilitated by the isokinetic exercise for enabling a knee joint exercise through an operation resulting from the user's movement, thereby enabling the improvement of a rehabilitation exercise effect. The isokinetic exercise mode 64 enables the lower leg-worn part 3 to be rotated by the driving device 50 at a predetermined constant velocity when the force applied by the user for moving his or her leg is detected.

The control device 60 further includes a general rehabilitation exercise mode 65 intended for exercising the user's knee joint using only an operation of the driving device 50 regardless of the user's movement.

The input part 61 may enable the selective input of the isokinetic exercise mode 64 and the general rehabilitation exercise mode 65. The input part 61 is intended for inputting corresponding conditions of uniform motion information according to the user's needs from the isokinetic exercise mode 64, thereby allowing the user to perform the uniform motion by enabling the lower leg-worn part to be rotated by the driving device 50 at a corresponding rotational speed.

Also, the general rehabilitation exercise mode 65 includes a plurality of operation modes.

The control device 60 includes: a mode operation controlling part 62 intended for selecting one mode from the general rehabilitation exercise mode 65 including the plurality of operation modes and the isokinetic exercise mode 64 and for controlling the driving device 50 according to each mode; and the input part 61 intended for selecting any one mode from among the plurality of operation modes provided in the mode operation part and for inputting an operation condition according to each selected mode.

The input part 61 may be connected to the mode operation controlling part 62 via cable or wireless communication.

The input part 61 includes a wireless controller connected to the mode operation controlling part 62 via the wireless communication and intended for selecting any one from among the plurality of operation modes and for inputting an operational condition according to each selected mode so that the portable rehabilitation exercise device can be more conveniently used.

The wireless controller has, even though they are not illustrated, a mode selection button, an input button capable of inputting information about an angle and a velocity, and a display panel, a USB terminal, or a wire connector terminal capable of confirming mode selection and inputted values, and the like.

Also, in the mode operation controlling part 62, the plurality of operation modes, namely, the general rehabilitation exercise mode 65 includes: a basic mode 65*a* intended for allowing the user to designate an operating angle range and an operating velocity of the lower leg-worn part 2 and for continuously operating the lower leg-worn part 2 at the designed operating angle range and velocity;

a timer mode 65*b* intended for allowing the user to designate an operating angle range and an operating velocity of the lower leg-worn part 2 and to set an operating time and for operating the lower leg-worn part 2 at the designated angle range and velocity for the set operating time;

a count mode 65*c* intended for allowing the user to designate an operating angle range and an operating velocity of the lower leg-worn part 2 and to set the number of operating times being repeated and for repeatedly operating the lower leg-worn part 2 as much as the set number of times at the designated angle range and velocity for the set operating time; and a progressive mode 65*d* intended for allowing the user to designate a maximum or minimum operating angle range and operating velocity of the lower leg-worn part 2 and to set an operating time, and for changing the operating angle range or the operating velocity of the lower leg-worn part and operating the lower leg-worn part 2 for the operating time.

Also, the control device 60 further includes a data storage part 63 connected to the mode operation controlling part and intended for storing an operating process of the driving device 50 from the mode operation controlling part 62.

The data storage part 63 is intended for storing information about the user's rehabilitation exercise process performed in a state of the user wearing the rehabilitation exercise device according to the present invention and for giving feedback on the information to the mode operation controlling part 62 so that the mode operation controlling part 62 can automatically operate the driving device 50 to correspond to a next rehabilitation step, namely, gradually stronger rehabilitation exercise intensity, and an effect of the rehabilitation process can be improved by enabling the user or a doctor to confirm the rehabilitation exercise process.

Figure 4:
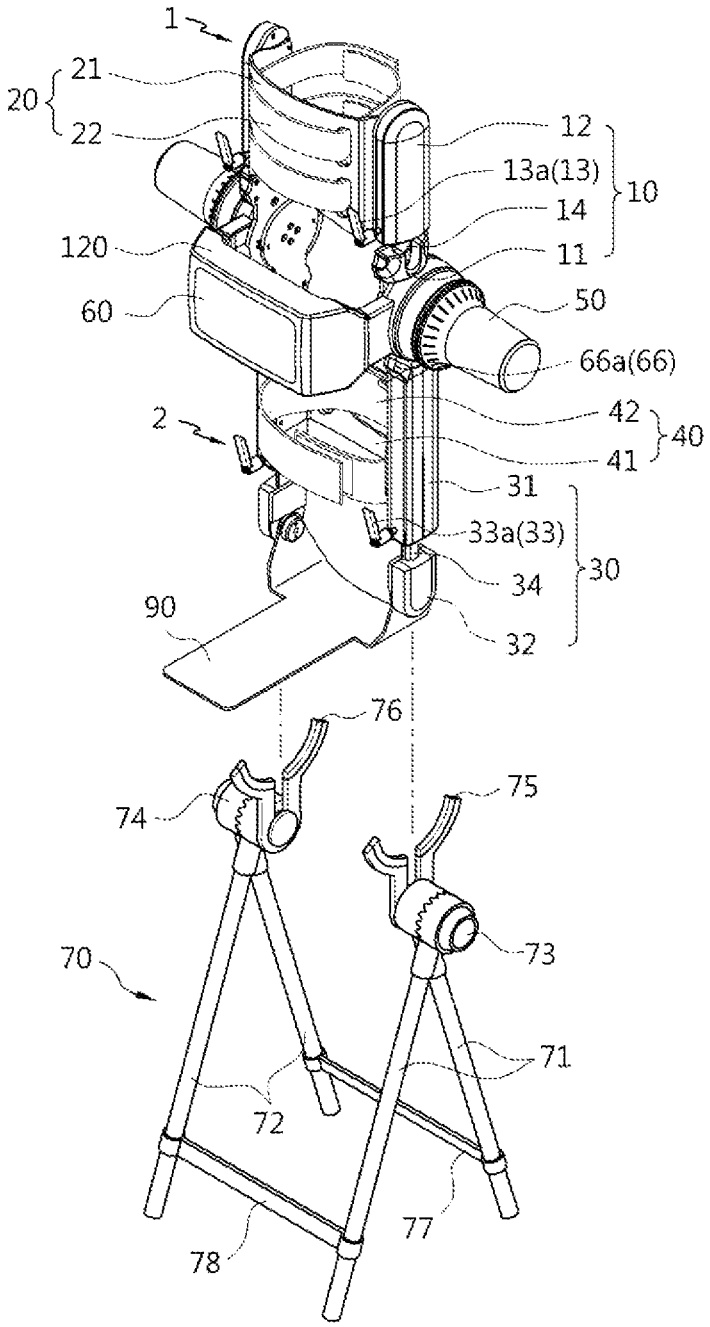
FIG. 4 is a perspective view illustrating the portable rehabilitation exercise device for the knee joint according to the present invention.
Figure 5:
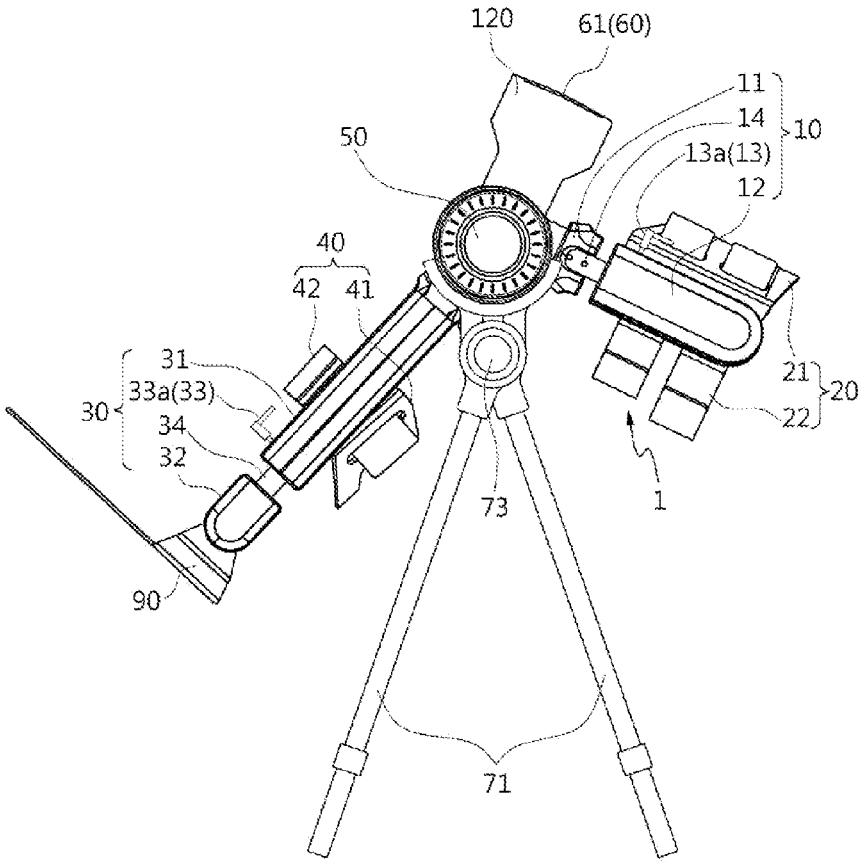
FIG. 5 is a side view illustrating the portable rehabilitation exercise device for the knee joint according to the present invention.

Referring to FIGS. 4 and 5, the first wearing member 20 includes: a thigh supporting bracket 21, both sides of which are each connected to the first mounting frame members 10, the thigh supporting bracket being disposed on a front side of the user's thigh; and a first belt 22 connected to the thigh supporting bracket 21 and worn to wrap the user's thigh.

The thigh supporting bracket 21 has a curved shape so as to wrap the user's thigh and supports the front side of the user's thigh when the user performs a rehabilitation exercise for the knee so that the rehabilitation exercise can be smoothly performed.

That is, the thigh supporting bracket 21 supports the front side of the thigh for the knee rehabilitation exercise performed by rotating the lower leg-worn part 2, and the calf supporting bracket 41 supports the calf of the lower leg so that the rehabilitation exercise can be smoothly performed.

It is preferable that each length of the first mounting frame members 10 can be adjusted. Each of the first mounting frame members 10 includes: a first thigh frame 11 connected to the lower leg-worn part 2;

a second thigh frame 12 movably connected to the first thigh frame 11 in a leg length direction; and a thigh frame fixing part 13 intended for fixing or releasing a position of the second thigh frame 12. The thigh frame fixing part 13 includes a first operation lever 13*a* and fixes or releases the position of the second thigh frame 12 by rotating the first operation lever 13*a*.

A movable guide beam 14 protruding in the leg length direction is provided at one side of the first thigh frame 11 and the second thigh frame 12, and a rail groove to which the movable guide beam 14 is movably connected in the leg length direction is formed at the other side. Each entire length of the first mounting frame members 10 is adjusted by moving the second thigh frame 12 in the leg length direction.

The first operation lever 13*a* includes a pressure tool intended for fixing the position of the second thigh frame by selectively pressurizing the movable guide beam 14. The first operation lever 13*a* is rotated in a direction so that the movable guide beam 14 can be pressurized by the pressure tool at a predetermined position and thus the position can be fixed. Also, the first operation lever is rotated in a different direction so that a pressuring state of the movable guide beam by the pressure tool can be released, thereby enabling the movable guide beam 14 to move. In particular, a position of the first band member 20 may be changed. The first mounting frame members 10 may be worn at a suitable position by changing the position to be worn according to each user's body type.

Each length of the second mounting frame members 30 may be adjusted so that the foot supporting member 90 can be worn on a user's foot according to each user's body type.

Each of the second mounting frame members 30 includes: a first lower leg frame 31 connected to the thigh-worn part 1;

a second lower leg frame 32 movably connected to the first lower leg frame 31 in a leg length direction; and a lower leg frame fixing part 33 intended for fixing or releasing a position of the second lower leg frame 32. The lower leg frame fixing part 33 includes a second operation lever 33*a*, thereby rotating the second operation lever 33*a* and fixing or releasing a position of the second lower leg frame 32. The foot supporting member 90 is mounted to the second lower leg frame 32.

A movable guide protrusion 34 protruding in the leg length direction is provided at one side of the first lower leg frame 31 and the second lower leg frame 32, and a movable guide groove to which the movable guide protrusion 34 is movably connected in the leg length direction is formed at the other side. An entire length of each of the second mounting frame members 30 may be adjusted by moving the second lower leg frame 32 in the leg length direction. In particular, a position of the foot supporting member 90 may be changed. The second operation lever 33*a* includes a pressure tool intended for fixing the position of the second lower leg frame by selectively pressurizing the movable guide protrusion 34. The second operation lever 33*a* is rotated in a direction so that the movable guide protrusion 34 can be pressurized by the pressure tool at a predetermined position and thus the position can be fixed. Also, the second operation lever is rotated in a different direction so that a pressuring state of the movable guide protrusion 34 by the pressure tool can be released, thereby enabling the movable guide protrusion to move.

Each length of the second mounting frame members 30 may be adjusted according to each user's body type so that the foot supporting member 90 can be easily worn on the user's foot.

The foot supporting member 90 is detachably provided to the second mounting frame members 30, so that the foot supporting member can be kept in a state of being separated from the second mounting frame members when not used.

Accordingly, the portable rehabilitation exercise device for the knee joint according to the present invention may be appropriately and stably worn and used according to the user's body type and the user's selection between his or her left and right knee.

The portable rehabilitation exercise device for a knee joint according to the present invention further includes a supporter member 70 installed to stand upright and intended for supporting the thigh-worn part 1 and the lower leg-worn part 2.

The supporter member 70 includes: a first leg supporting part 71 composed of two supporting legs rotatably connected to each other;

a second leg supporting part 72 composed of two supporting legs rotatably connected to each other;

a first hinge part 73 rotatably connecting the two supporting legs of the first leg supporting part 71;

a second hinge part 74 rotatably connecting the two supporting legs of the second leg supporting part 72;

a first frame supporting part 75 intended for supporting one of the connection portions between the thigh-worn part 1 and the lower leg-worn part 2 and provided at an upper portion of the first leg supporting part 71; and a second frame supporting part 76 intended for supporting another of the connection portions between the thigh-worn part 1 and the lower leg-worn part 2 and provided at an upper portion of the second leg supporting part 72.

The connection portions between the thigh-worn part 1 and the lower leg-worn part 2, namely, the connection portions between the first mounting frame members 10 and the second mounting frame members 30 are mounted to an upper portion of the first frame supporting part 75 and an upper portion of the second frame supporting part 76, respectively and are supported.

It is preferable that each of the first frame supporting part 75 and the second frame supporting part 76 be formed to have a fixed circular arc.

The supporter member 70 supports the thigh-worn part and the lower leg-worn part 2 in a suitable height to be used by the user so that the user can perform the rehabilitation exercise in a stable posture.

Furthermore, the supporter member 70 is configured such that each of the first leg supporting part 71 and the second leg supporting part 72 is composed of two rotatable legs so that the supporter members can be maintained in a state of the two legs being folded, thereby having excellent portability and an excellent storage property.

It is preferable that the supporter member 70 further include a first leg connecting part 77 connecting any one leg of the first leg supporting part 71 and one leg of the second leg supporting part 72 positioned to correspond to the one leg of the first leg supporting part; a second leg connecting part 78 connecting the other leg of the first leg supporting part and the other leg of the second supporting part 72 positioned to correspond to the other leg of the first leg supporting part.

The two legs of the first leg supporting part 71 and the two legs of the second leg supporting part 72 are connected to the first leg connecting part 77 and the second leg connecting part 78 so as to be simultaneously unfolded at the same angle, thereby stably supporting the first mounting frame members 10 and the second mounting frame members 30.

Also, it is preferable that the first leg supporting part 71 and the second leg supporting part 72 be provided so as to limit the angle between the two legs.

Figure 6:
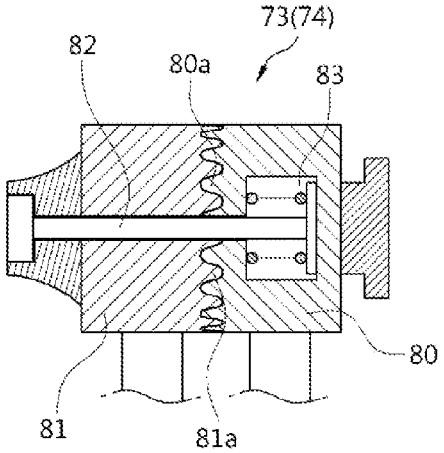
FIGS. 6 and 7 are enlarged cross-sectional views illustrating the structure of a support in one example of the present invention.
Figure 7:
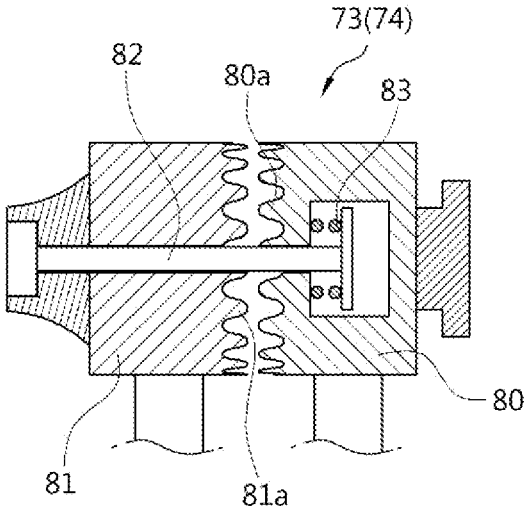
Figure 8:
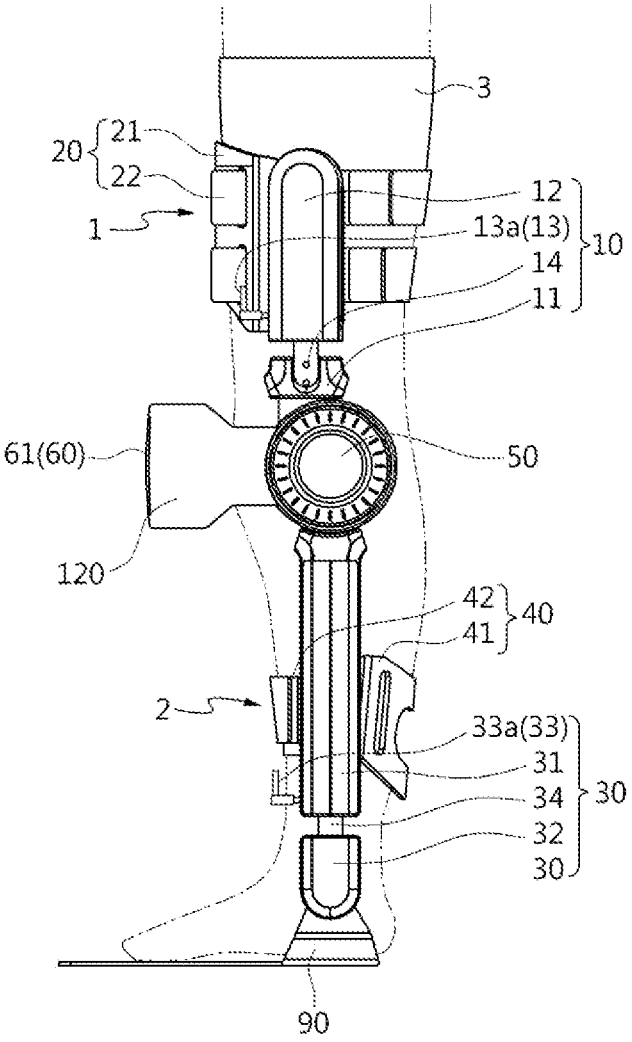
FIG. 8 is a side view showing a state in which the present invention is worn.

As illustrated in FIGS. 6 and 7, any one of the first hinge part 73 and the second hinge part 74 includes: a first hinge body 80 to which any one of two legs is connected, the first hinge body having a plurality of first engaging teeth 80*a* separated on one side;

a second hinge body 81 to which any one of the two legs is connected, the second hinge body having a plurality of second engaging teeth 81*a* formed on one side of the second hinge body in contact with the one side of the first hinge body 80 and separated to engage with the first engaging teeth 80*a;* a hinge axis 82 passing through the first hinge body 80 and the second hinge body 81, one side of the hinge axis is connected to the first hinge body 80, and the other side is connected to the second hinge body 81; and an elastic body 83 intended for elastically supporting the hinge axis 82 passing through the first hinge body 80 and for maintaining the first engaging teeth 80*a* of the first hinge body 80 and the second engaging teeth 81*a* of the second hinge body 81 in an engaged state.

As one example, a coil spring is used as the elastic body 83.

That is, as illustrated in FIG. 6, the first engaging teeth 80*a* of the first hinge body 80 and the second engaging teeth 81*a* of the second hinge body 81 are maintained in a state of being elastically supported and engaged by the elastic body 83, thereby fixing the angle between the two legs of each of the first leg supporting part 71 and the second leg supporting part 72.

Also, when the engaging state of the first engaging teeth 80*a* and the second engaging teeth 81*a* is released by forcibly broadening a distance between the first hinge body 80 and the second hinge body 81 with a force, the second hinge body 81 may be rotated so that the angle between the two legs of each of the first leg supporting part 71 and the second leg supporting part 72 can be adjusted.

As described above, after the angle between the two legs has been adjusted, when the force applied for forcibly broadening the distance the first hinge body 80 and the second hinge body 81 is released, the first engaging teeth 80*a* of the first hinge body 80 and the second engaging teeth 81*a* of the second hinge body 81 engage with each other due to an elastic restoring force so that the two legs of the first leg supporting part 71 and the two legs of the second leg supporting part 72 can be fixed at the adjusted angle again.

Referring to FIG. 7, the portable rehabilitation exercise device for the knee joint according to the present invention may be used in a state of the user wearing a stocking 3 on his or her leg. Also, as one example, the sensor member 66 is mounted to an inner side of the second wearing member, and a ring (not drawn) connected to the tension-compression sensor 66*a* is provided at the stocking.

Also, after the user has put the stocking on his or her leg, when the stocking is connected to the tension-compression sensor 66*a* using the ring, and the second wearing member is put on the user's lower leg, the tension-compression sensor 66*a* may detect a force intended by the user for rotating his or her lower leg, namely, a force for lifting or lower the lower leg.

The force detected by the tension-compression sensor 66*a* is transmitted to the control device 60, and the control device 60 controls an operation of the driving device 50 according to a direction and magnitude of the force detected by the tension-compression sensor 66*a*.

An example in which a knee rehabilitation exercise is performed using the present invention will be described below.

The portable rehabilitation exercise device for the knee joint according to the present invention is used by placing the user's leg between the first mounting frame members 10 and the second mounting frame members 30, and thereafter, wrapping the user's thigh and lower leg using the first band member 20 and the second band member 40 for fixing the user's leg and by putting the foot supporting member 90 on the user's foot. Furthermore, the portable rehabilitation exercise for the knee joint according to the present invention is configured such that each length of the first mounting frame members 10 is adjusted according to the user' body type so that the first mounting frame members can be mounted to a suitable position for the user's thigh, and each length of the second mounting frame members is adjusted so that the foot supporting member 90 can be simply worn on the user's foot.

That is, as described above, after wearing the thigh-worn part 1 and the lower leg-worn part 2 on the user's leg, the user selects any one mode of the general rehabilitation exercise mode 65 and the isokinetic exercise mode 64 via the input part 61.

Furthermore, when the general rehabilitation exercise mode 65 is selected via the input part 61, according to the selected operation mode, input values, such as an operational angle range, velocity, time, the number of operating times being repeated, and the like, are input, and as a result, the mode operation controlling part 62 controls an operation of the driving device 50 so that the user can take exercise via the second mounting frame members 30 based on the input values.

Also, when the isokinetic exercise mode 64 is selected via the input part 61, the sensor member 66 detects a force applied by the user for rotating his or her lower leg, namely, a force applied by the user for lifting or lowering his or her lower leg so that the operation of the driving device 50 can be controlled.

As described above, the input values upon the operation for the knee rehabilitation exercise, namely, rehabilitation exercise data, is stored in the data storage part 63 so as to be updated for giving feedback and utilized according to the need.

According to the present invention, the general rehabilitation exercise capable of exercising the user's knee joint by only the operation of the driving device 50 and the isokinetic exercise capable of exercising the user's knee joint by the operation resulting from the user's movement may be selectively used so that a rehabilitation effect of the knee joint can be largely improved.

The rehabilitation exercise device according to the present invention is portable and easy to use even in a small space. Furthermore, the rehabilitation exercise device can be operated only when the user's motion is detected, and can store the user's rehabilitation exercise information and can update the information by giving feedback, thereby improving a knee joint rehabilitation effect.

The portable rehabilitation exercise device for the knee joint according to the present invention may be appropriately worn according to the user's body type and the user's selection between his or her left and right knees so that convenience can be largely improved and a rehabilitation effect can be also improved.

Although the embodiments of the present invention have been described for illustrative purposes, the present should not be limited to the embodiments, and those skilled in the art will appreciate that various modifications, additions and substitutions are possible, without departing from the scope and spirit of the invention, and are included in the configuration of the invention.

The invention claimed is:

1. A portable rehabilitation exercise device for a knee joint, comprising:

a thigh-worn part worn on a user's thigh;

a lower leg-worn part rotatably connected to the thigh-worn part and worn on a user's lower leg;

a driving device mounted to connection portions between the thigh-worn part and the lower leg-worn part and intended for rotatably operating the lower leg-worn part;

a control device controlling an operation of the driving device;

a sensor member mounted to the lower leg-worn part, connected to the control device, and intended for detecting a moving direction of the user's lower leg wherein the lower leg-worn part comprises:

second mounting frame members rotatably connected to each one end of first mounting frame members and each disposed on both sides of the user's lower leg; and a second wearing member provided in the second mounting frame members and worn to wrap the user's lower leg, wherein the second wearing member comprises:

a calf supporting bracket, both sides of which are each connected to the second mounting frame members, the calf supporting bracket being disposed on a calf; and a second belt connected to the calf supporting bracket and worn to wrap the user's thigh, wherein the sensor member is a tension-compression sensor, both ends of which are mounted to the calf supporting bracket and the second belt, the tension-compression sensor connecting the calf supporting bracket and the second belt.

2. The portable rehabilitation exercise device as set forth in claim 1, wherein the sensor member detects a direction of force when the user applies a certain amount or more of force to the moving direction intended for rotating the lower leg using his or her knee and transmits detected direction information to the control device, and the control device rotates the lower leg-worn part in the direction of the force detected by the sensor member.

3. The portable rehabilitation exercise device as set forth in claim 2, wherein the control device enables the user to perform an isokinetic exercise via the lower leg-worn part at a predetermined rotating velocity, according to the user's needs.

4. The portable rehabilitation exercise device as set forth in claim 3, wherein the control device rotates the lower leg-worn part uniformly at the predetermined rotating velocity according to the user's need only when the sensor member detects the user's force.

5. The portable rehabilitation exercise device as set forth in claim 1, further comprising a lower leg supporting pad member detachably mounted to an inner surface of the second mounting frame members.

6. The portable rehabilitation exercise device as set forth in claim 1, wherein the control device further comprises:

an isokinetic exercise mode intended for rotating the lower leg-worn part at a predetermined constant velocity according to the user's needs using the driving device when the user's force for moving his or her leg is detected; and a general rehabilitation exercise mode intended for exercising the user' knee joint using only an operation of the driving device regardless of his or her movement.

7. The portable rehabilitation exercise device as set forth in claim 6, wherein the general rehabilitation exercise mode comprises a plurality of operation modes.

8. The portable rehabilitation exercise device as set forth in claim 7, wherein the control device comprises:

a mode operation controlling part intended for selecting one mode from the general rehabilitation exercise mode including the plurality of operation modes and the isokinetic exercise mode and for controlling the driving device according to each mode; and an input part intended for selecting any one mode from among the plurality of operation modes provided in the mode operation part and for inputting an operation condition according to each selected mode.

9. The portable rehabilitation exercise device as set forth in claim 8, wherein the control device further comprises a data storage part connected to the mode operation controlling part and intended for storing an operating process of the linked driving device from the mode operation controlling part.

10. The portable rehabilitation exercise device as set forth in claim 6, wherein the general rehabilitation exercise mode comprises:

a basic mode intended for allowing the user to designate an operating angle range and an operating velocity of the lower leg-worn part and for continuously operating the lower leg-worn part at the designed operating angle range and velocity;

a timer mode intended for allowing the user to designate an operating angle range and an operating velocity of the lower leg-worn part and to set an operating time and for operating the lower leg-worn part at the designated angle range and velocity for the set operating time;

a count mode intended for allowing the user to designate an operating angle range and an operating velocity of the lower leg-worn part and to set the number of operating times being repeated and for repeatedly operating the lower leg-worn part as much as the set number of times at the designated angle range and velocity for the set operating time; and a progressive mode intended for allowing the user to designate a maximum or minimum operating angle range and operating velocity of the lower leg-worn part and to set an operating time, and for changing the operating angle range or the operating velocity of the lower leg-worn part and operating the lower leg-worn part for the operating time.

11. The portable rehabilitation exercise device as set forth in claim 1, further comprising a knee covering member mounted to the connection portions between the thigh-worn part and the lower leg-worn part and intended for covering the user's knee.

12. The portable rehabilitation exercise device as set forth in claim 11, wherein the control device is mounted to the knee covering member.

13. The portable rehabilitation exercise device as set forth in claim 1, wherein the thigh-worn part comprises:

first mounting frame members each disposed on both sides of the user's thigh; and a first wearing member provided in the first mounting frame members and worn to wrap the user's thigh.

14. The portable rehabilitation exercise device as set forth in claim 13, further comprising a thigh supporting pad member detachably mounted to an inner surface of the first mounting frame members.

15. The portable rehabilitation exercise device as set forth in claim 13, wherein each of the first mounting frame members has an adjustable length.

16. The portable rehabilitation exercise device as set forth in claim 13, wherein each of the first mounting frame members comprises:

a first thigh frame connected to the lower leg-worn part;

a second thigh frame movably connected to the first thigh frame in a leg length direction; and a thigh frame fixing part intended for fixing or releasing a position of the second thigh frame.

* * * * *